US008291851B2

(12) United States Patent
Strahm et al.

(10) Patent No.: US 8,291,851 B2
(45) **Date of Patent: *Oct. 23, 2012**

(54) MODULAR REMOVABLE CONSOLE FOR A BOAT

(75) Inventors: Greg Strahm, Shelbyville, TN (US); Gary Clouse, LaVergne, TN (US)

(73) Assignee: CJBBB, Inc., Tullahoma, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/048,242

(22) Filed: Mar. 15, 2011

(65) Prior Publication Data

US 2011/0162574 A1 Jul. 7, 2011

Related U.S. Application Data

(63) Continuation of application No. 12/403,227, filed on Mar. 12, 2009, now Pat. No. 7,908,990.

(51) Int. Cl.
*B63B 17/00* (2006.01)

(52) U.S. Cl. ..... 114/364; 296/70

(58) Field of Classification Search ..... 114/343, 114/361, 364; 296/70

See application file for complete search history.

(56) References Cited

U.S. PATENT DOCUMENTS

| | | | |
|---|---|---|---|
| 4,706,810 | A | 11/1987 | Petrilli |
| 5,143,013 | A | 9/1992 | Huebner |
| 6,739,281 | B1 | 5/2004 | Grimes |
| 7,096,818 | B2 | 8/2006 | Kalil |

*Primary Examiner* — Lars A Olson

(74) *Attorney, Agent, or Firm* — PatentBest; Andrew McAleavey

(57) ABSTRACT

A removable console for a boat and a boat including such a removable console are disclosed. The removable console is adapted to be positioned before a passenger seating position in the boat to shield the passenger position from wind. The connection between the deck of the boat and the removable console is fastenerless, so as to facilitate easy installation and replacement. The console itself may be enclosed, with both upper and lower surfaces.

12 Claims, 8 Drawing Sheets

MODULAR REMOVABLE CONSOLE FOR A BOAT

CROSS-REFERENCE TO RELATED APPLICATIONS

This application is a continuation of U.S. patent application Ser. No. 12/403,227, filed Mar. 12, 2009.

BACKGROUND OF THE INVENTION

1. Field of the Invention

The invention relates generally to boating and marine structures and, more particularly, to a modular removable console for a boat.

2. Description of Related Art

Bass boats are small boats designed for recreational fishing, usually in freshwater. Generally 18-22 feet in length and made of FIBERGLAS or aluminum, they are typically powered by an outboard motor or motors and commonly provide seating for two passengers, usually in the form of swivel chairs.

In a typical arrangement, there are two side-by-side chairs in a bass boat. By custom, the pilot's chair is on the right (i.e., the starboard side) and faces a console that includes the engine and rudder controls and instrument displays. A windscreen may also be attached to the console to shield the pilot from the wind. Many bass boats also place a console without instruments facing the left-hand (i.e., port) or passenger side, solely to provide a windscreen for the passenger.

While a passenger-side console with windscreen is helpful if two passengers are in the boat, if the pilot is alone, the second console can create a visual obstruction and limit visibility. Additionally, in some climates, particularly warmer ones, a passenger-side windscreen may be unnecessary. Therefore, some bass boats are made with a removable passenger-side console. However, most of these removable consoles are placed and removed by way of a complex mechanism that requires, for example, bolting and unbolting various components. While this kind of console may be removable, it is not necessarily easy to do so.

SUMMARY OF THE INVENTION

One aspect of the invention relates to a removable console for a boat. The removable console includes a rear portion, an upper surface, and a horizontal portion. The rear portion includes a plurality of horizontally-extending connecting members that are spaced from one another and are dimensioned to be inserted into a corresponding plurality of receptacles in a boat. The upper surface is connected to an upper edge of the rear portion and extends at least generally outwardly and forwardly therefrom. The horizontal portion is connected to the rear portion and extends horizontally therefrom on at least one side of the removable console. The horizontal portion is constructed and arranged to be releasably secured to the boat and includes an operable engaging portion of a lock.

Another aspect of the invention relates to a boat. The boat includes a hull and a deck arranged within the hull. The boat also includes a connecting plate provided in a portion of the deck. The connecting plate makes an angle with the horizontal and includes a plurality of receptacles, each receptacle spaced from the others. The boat also includes a removable console, as described above, and a receiving bracket. The connecting members of the removable console are constructed and arranged to be inserted into the receptacles of the connecting plate. The receiving bracket is connected to an interior portion of the boat spaced from the connecting plate and is arranged to receive and support the horizontal portion of the removable console. The receiving bracket includes a lock receptacle constructed and arranged to lockingly engage the operable engaging portion of a lock carried by the horizontal portion of the removable console.

Yet another aspect of the invention relates to an enclosed removable console for a boat, including a lower surface that connects with the upper surface of the removable console to enclose at least a portion of the console.

Other aspects, features, and advantages of the invention will be set forth in the description that follows.

BRIEF DESCRIPTION OF THE DRAWINGS

The invention will be described with respect to the following drawing figures, in which like numerals represent like features throughout the views, and in which.

DETAILED DESCRIPTION

Figure 1:
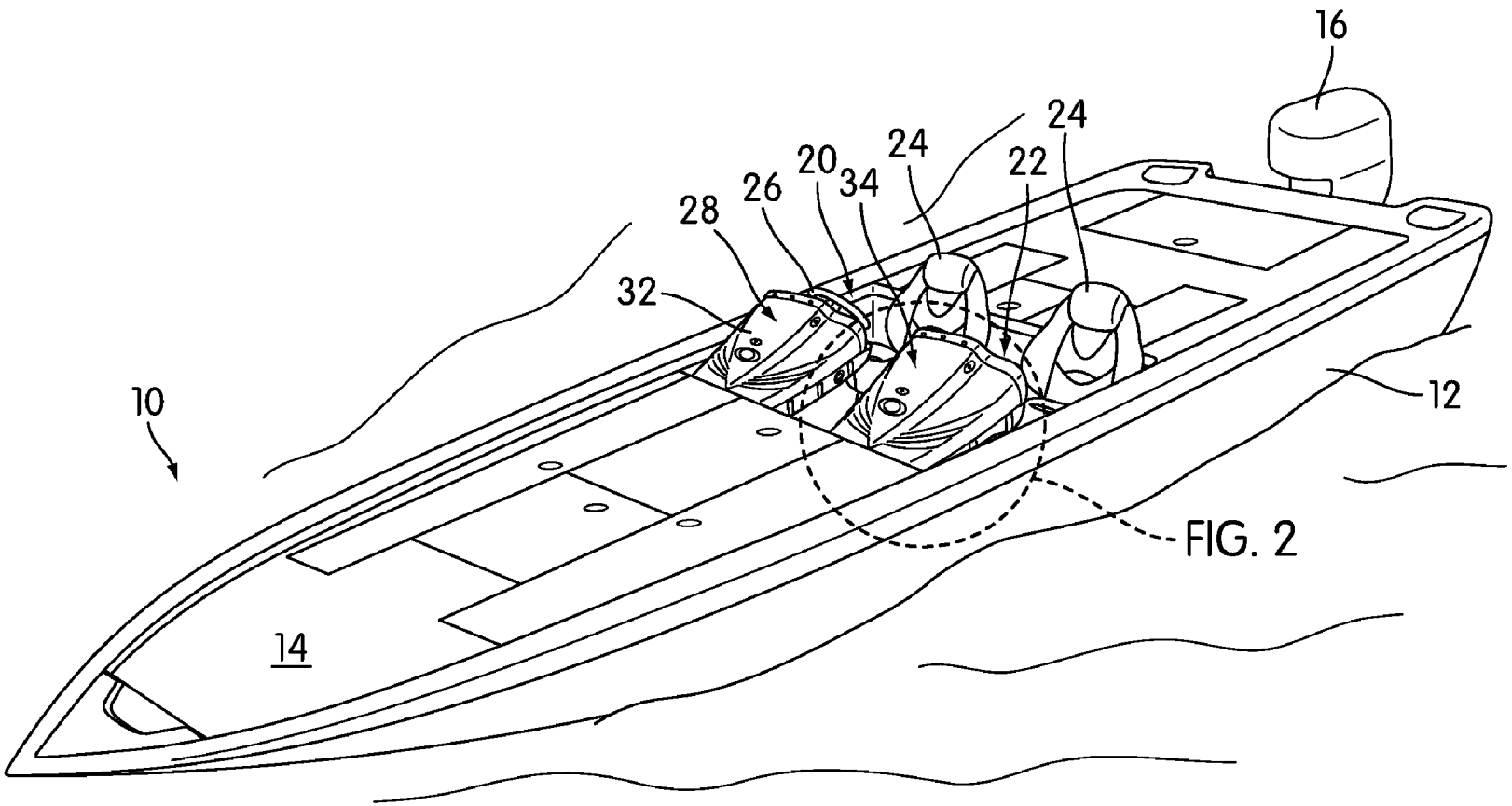
FIG. 1 is a perspective view of a boat according to one embodiment of the invention.

FIG. 1 is a perspective view of a boat, generally indicated at 10. The boat 10 includes a hull 12 and a deck 14. The boat 10 is generally of the type used for recreational fishing, and in particular, for bass fishing, although boats 10 according to embodiments of the invention need not be limited to those uses. An outboard motor 16 is provided to propel the boat 10, and in some embodiments, the boat 10 may also include a separate trolling motor for low-speed propulsion during fishing operations (not shown in FIG. 1). The hull 12 and deck 14 of the boat 10 of the illustrated embodiment are made of FIBERGLAS glass fiber composite, although in other embodiments, they may be made of other materials.

The boat 10 of FIG. 1 includes two passenger positions side-by-side, one passenger position 20 on the starboard (i.e., right) side and one passenger position on the port (i.e., left) side 22. Each passenger position 20, 22 includes a chair 24. The chairs 24 of the illustrated embodiment are fixed in forward-facing positions, although chairs 24 in other embodiments of the invention may swivel or have any other desirable features. By convention, the starboard-side passenger position 20 is the pilot's position, although this need not be the case in all embodiments. Because it is the pilot's position, the starboard-side passenger position 20 includes engine controls and a wheel for rudder control, collectively indicated at 26, and a console 28 that includes instrument displays. A windscreen may be connected to an upper surface 32 of the console 28 to shield the pilot from wind.

In the illustration of FIG. 1, the port-side passenger position 22 also has a console 34 installed between the bow and the passenger chair 24 to shield the passenger chair 24 from wind. The console 34 is also adapted to be connected to a windscreen 36. However, in boats 10 according to embodiments of the invention, the console 34 is removable. Therefore, if there is no passenger or if the climate does not warrant it, the console 34 can be removed. Removing the console 34 may provide better visibility for the pilot. Moreover, as will be described below in more detail, the manner in which the console 34 and the boat 10 engage is such that the console 34 may be easily removed and replaced.

Figure 2:
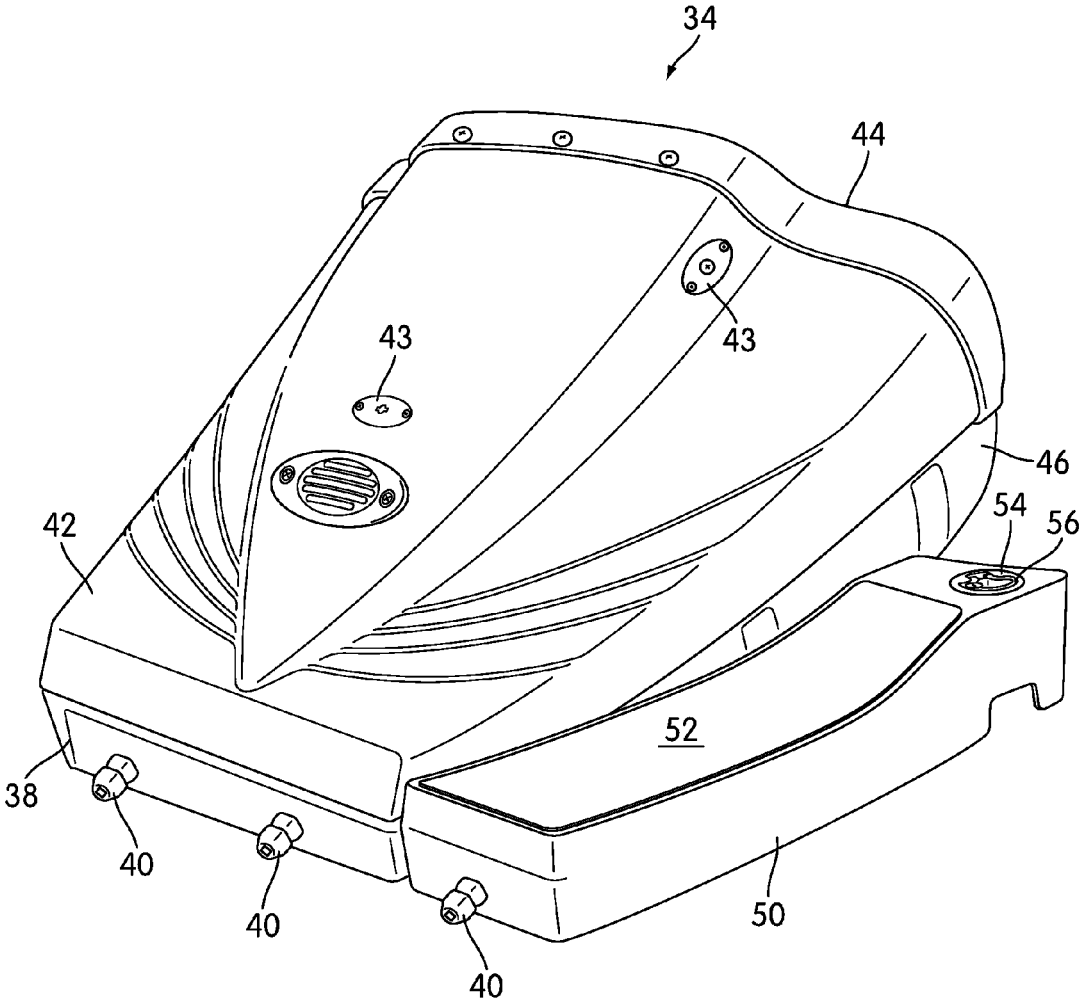
FIG. 2 is a rear perspective view of a removable console that may be removably placed in the boat of FIG. 1.

FIG. 2 is a rear perspective view of the removable console 34 in isolation. The console 34 has a rear portion 38 that, in the illustrated embodiment, is generally vertical in orientation. The rear portion 38 is constructed and arranged to be connected to the deck 14, or, in other embodiments, to other portions of the boat 10. To that end, the boat 10 has a plurality of horizontally extending connecting members 40 that are fixed to the rear portion 38 and are spaced from one another. In the console 34, there are three connecting members 40, each evenly spaced from the others, although more or fewer members may be used in other embodiments. As those of skill in the art will realize, it is generally advantageous to use at least two connecting members 40, although a single connecting structure may be used, particularly if it is larger or more extensive than the connecting members 40.

In the illustrated embodiment, the console 34 does not include any instrumentation. However, in other embodiments of the invention, the console 34 may include instrumentation, in which case the rear portion 38 may include an opening through which a wiring harness could pass or may include some form of electrical connector for the instruments. Additionally, the rear portion 38 may include any other connector or structure that is desirable in allowing the console 34 to connect to the boat 10.

The console 34 also has an upper surface 42 that is connected to and contiguous with the rear portion 38. In the illustrated embodiment, the upper surface 42 is a curved and contoured surface that extends upward and sternward from the rear portion 38. The upper surface 42 includes attachment points 43 for a windscreen. The upper surface 42 may have essentially any shape or features, although it may be useful if that shape is at least somewhat aerodynamic. As shown in FIG. 2, the upper surface 42 of the console 34 has a central raised portion that slopes down toward the left and right sides of the surface.

It should be understood that for reasons of symmetry, appearance, and ease in manufacturing, the console 34 may be made to look substantially similar or identical to the console 28 on the starboard-side position 20, at least externally. Making the two consoles 28, 34 substantially identical may allow some of the same molds and tooling to be used for both. For reasons of identity or symmetry, the console 34 may also include nonfunctional pieces or trim to match those of the other console 28.

Figure 3:
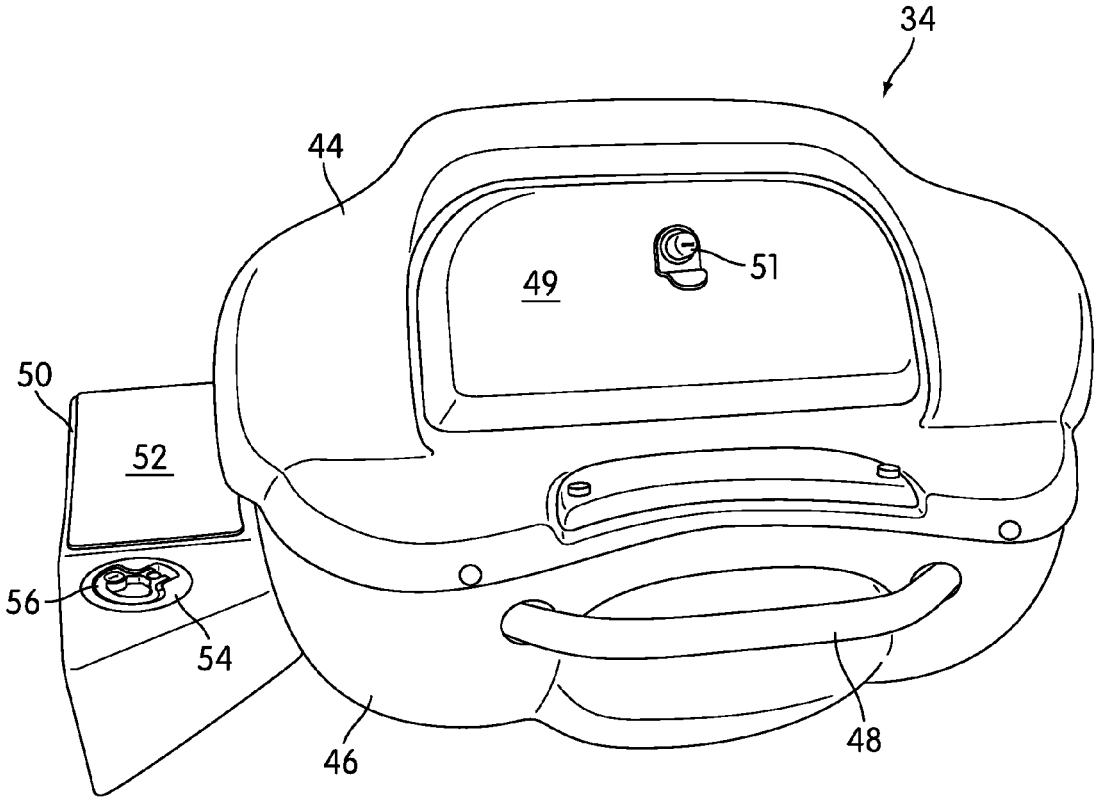
FIG. 3 is a front perspective view of the removable console of FIG. 2.

FIG. 3 is a front elevational view of the console 34. As shown, the console 34 also includes a front surface 44 that faces the passenger position 22. The front surface 44 need not be planar, and as shown in FIG. 3, the front surface 44 of the illustrated embodiment is a complex, three-dimensional surface that, like the other parts of the console 34, may have an overall shape that is generally similar to that of the console 28. As shown in FIG. 3, the front surface 44 of the console 34 is generally L-shaped, beginning in a generally vertical orientation where it meets the upper surface 42 and sloping downwardly and forwardly into a nearly horizontal orientation where it meets a lower surface 46 of the console, which will be described below in more detail. Additionally, as shown in FIG. 2, the front surface 44 has a rearwardly extending lip that overlaps the edges of the upper and lower surfaces 42, 46 where it meets them, so as to provide better engagement and sealing between those structures.

The front surface 44 of the console 34 may provide any desired features. In some embodiments, it may carry instruments. However, in many embodiments, the console 34 may serve primarily to shield the passenger position 22 from wind, in which case instruments would generally not be necessary. In the illustrated embodiment, the console 34 includes a storage compartment, the door 49 of which forms a part of the front surface 44. As with a traditional automobile glove compartment, the compartment in the console includes a lock 51. As those of skill in the art will realize, the console 34 need not include a compartment or any other such features, and may not include a compartment in all embodiments.

In the illustrated embodiment, both consoles 28, 34 are enclosed; that is, the lower surface 46 is constructed and arranged to mate with the upper surface 42 and the front surface 44 to enclose at least a portion of the console 34. In addition to enclosing the console 34, the lower surface 46 also accommodates a handrail 48, and may include other features as well. Those of skill in the art will understand that the various surfaces of the consoles 28, 34 may be manufactured and assembled using any known processes. For example, FIBERGLAS parts may be molded, and in particular, the upper and lower surfaces 42, 46 may be bonded together using an adhesive such as methyl methacrylate adhesive. However, it should also be understood that the front surface 44 of the console 34 may be attached to the upper and lower surfaces 42, 46 by different means than those by which the upper and lower surfaces 42, 46 are attached to one another. For example, as can be seen in FIG. 2, the front surface 44 may be removably secured with fasteners. The use of removable securement for the front surface 44 may be particularly advantageous in some embodiments because it allows the front surface 44 to be removed if it is necessary to service components inside of the console 34. Depending on the embodiment, the connections or interfaces between the structures that define the console 34 may be weatherproofed or sealed using any conventional technologies, including caulking, gaskets, O-rings, and the like.

Because both consoles 28, 34 are fully enclosed, the two consoles 28, 34 may have additional stability and resistance to vibrational stresses as compared with unenclosed consoles. However, the consoles 28, 34 need not be fully enclosed, or enclosed at all, in every embodiment.

The console 34 also includes a generally horizontal portion 50 that is connected to the upper and lower surfaces 42, 46 and extends horizontally to one side of the console 34. The horizontal portion 50 provides a surface on which the passenger may place objects, and also provides an additional point of attachment to the boat 10, as will be described below in more detail. As shown in FIG. 2, the upper surface of the horizontal portion 50 may be covered with nonskid material 52 (e.g., rubber) to facilitate its use. The horizontal portion 50 also carries an operable engaging portion of a locking or cam locking system, shown generally as 54, whose purpose is to releasably lock the console 34 into engagement with the boat 10 to secure it. The rotating handle 56 of the locking system 54 can be seen on the upper surface of the horizontal portion 50, and the locking system 54 itself will be described in more detail below.

Figure 4:
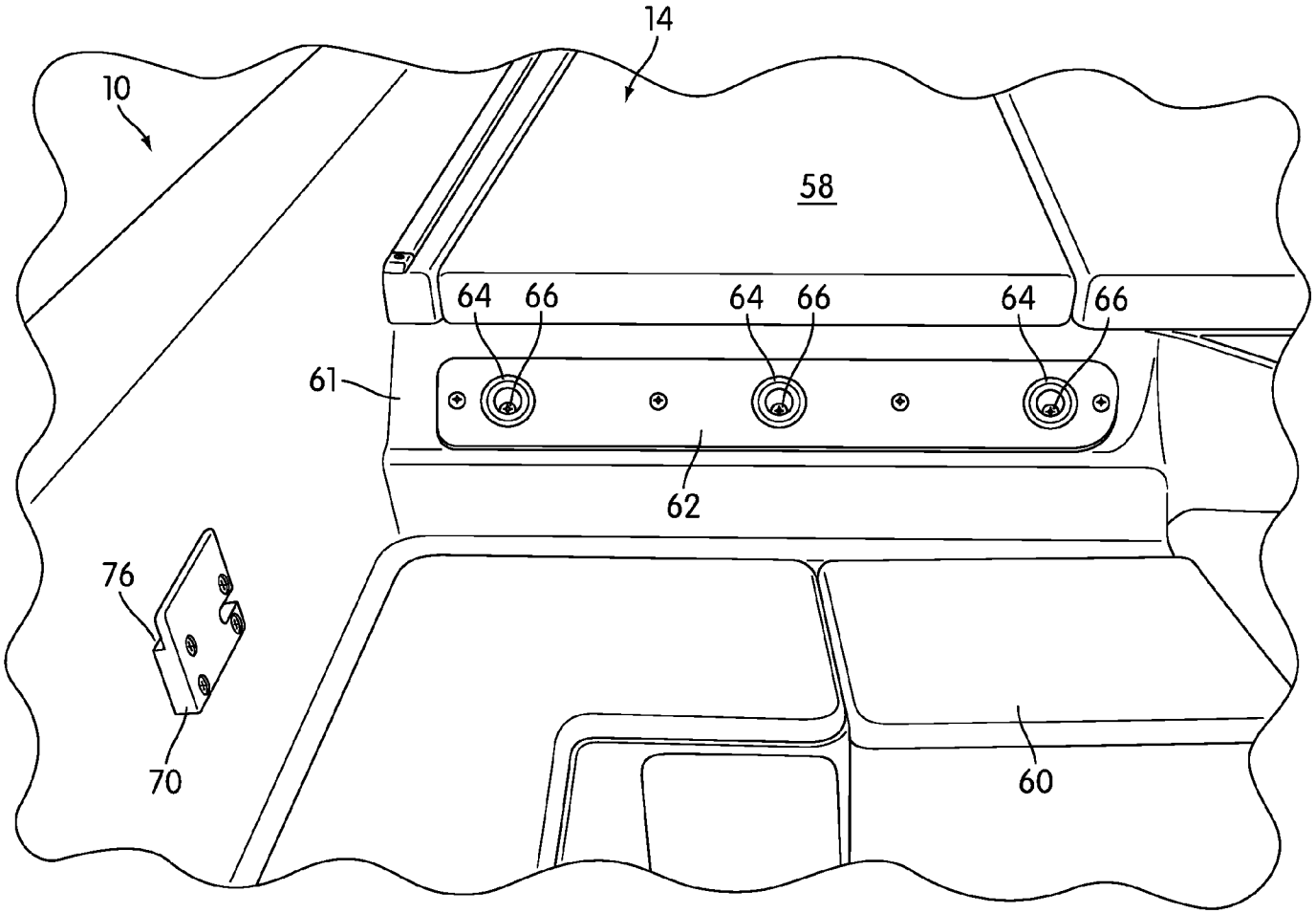
FIG. 4 is a perspective view of the deck of the boat of FIG. 1 with the console removed, illustrating the engaging structure for the console on the deck.

FIG. 4 is a perspective view of the area of the boat 10 to which the console 34 is attached, shown without the console 34 installed. As shown, the deck 14 makes a step down proximate to the port and starboard passenger positions 20, 22, dividing the deck into upper 58 and lower 60 portions. In the area of the step down, the deck 14 is formed to include an angled portion 61 that makes an angle with the horizontal of approximately 30 degrees. Provided on the angled portion 61 is a connecting plate 62. The connecting plate 62 includes a plurality of openings 64, each spaced from one another, and each carrying a port or receptacle 66 that is constructed and adapted to receive one of the connecting members 40.

The connecting members 40 and the corresponding receptacles 66 may be of any shape and characteristics, as long as they fit together and engage one another. In particularly advantageous embodiments, the connecting members 40 and receptacles 66 may comprise pre-matched sets of hardware. For example, recreational vehicle door holders may be used for the connecting members 40 and receptacles 66. In particular, the low profile bumper door holder #10665 sold by JR Products (Clarence Center, N.Y., United States), made of a plastic material, is particularly suitable. The heads 68 of the connecting members 40 may be modified in shape by cutting, carving or some other process so as to enter the receptacles 66 with less resistance. In the illustrated embodiment, for example, the connecting members 40 may have heads 68 with a generally octagonal cross-section (best seen in the view of FIG. 6).

As shown in FIG. 4, a receiving bracket 70 is mounted on the interior port sidewall of the boat 10 spaced from the connecting plate 62. The receiving bracket 70 may, for example, be made of a metal, such as aluminum, and may be secured to the sidewall by screws, bolts, or other fasteners. The receiving bracket 70 provides support to and locking engagement with the console 34 when it is installed, as will be described below in more detail.

Although the primary purpose of the receptacles 66 and the receiving bracket 70 is to secure the removable console 34, that is not the only purpose to which these structures may be put. For example, when the removable console 34 is not present, the connecting plate 62 may be covered by a decorative plate that is secured into the receptacles. Of course, in addition to a removable console 34, any other kind of structure may be secured into the boat 10. The removable bracket 70 may, for example, be used to support a drink holder when no console 34 is present. Covering the receptacles 66 and receiving bracket 70 when not supporting a console 34 is advantageous in that it may prevent corrosion or wear on the parts and may also cover any sharp edges that might otherwise create a hazard.

Figure 5:
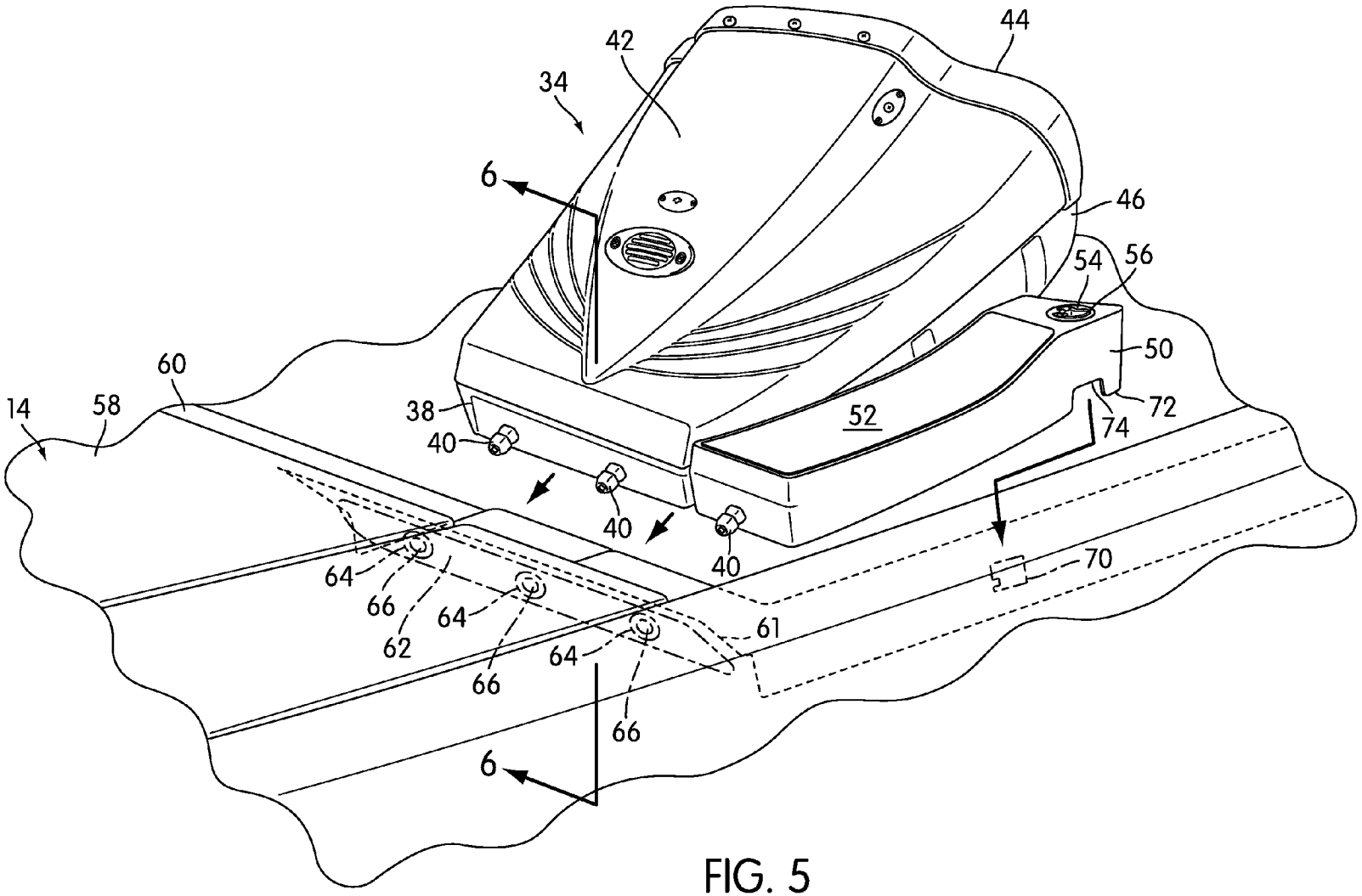
FIG. 5 is an exploded view of the console-boat interface, illustrating the general process of installing the console on the boat.

FIG. 5 is an exploded perspective view of the console 34 and a portion of the boat deck 14 proximate to the step down. As shown, in order to install the console 34, one inserts the connecting members 40 into the corresponding receptacles 66. Additionally, as shown in FIG. 5, the edge of the horizontal portion 50 forms a downwardly-extending lip 72. That lip 72 has a generally rectangular cut-out 74 arranged so as to correspond to the position of the receiving bracket 70. As can be appreciated from FIGS. 4 and 5, when the console 34 is installed, the cut-out portion 74 of the lip 72 is received by and fits within a horizontally-oriented slot or channel 76 defined in the upper edge of the receiving bracket 70 between the bracket 70 and the interior sidewall of the hull 12 of the boat 10, where it is supported by the bracket 70.

Figure 6:
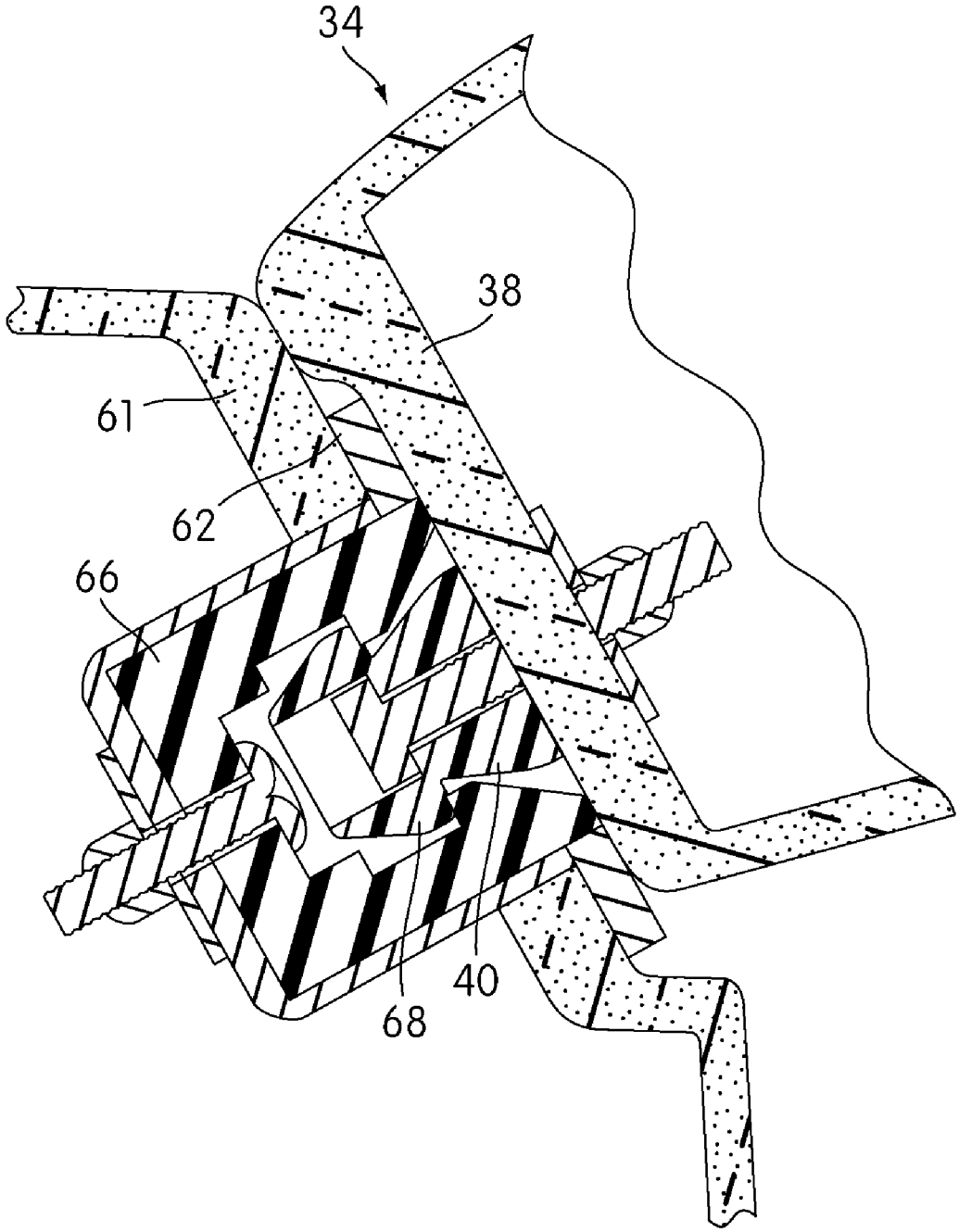
FIG. 6 is a sectional view of a portion of the boat, taken through Line 5-5 of FIG. 4, illustrating the manner of engagement of console and boat.

FIG. 6 is a sectional view of a portion of the engaged console 34 and deck 14, taken through Line 6-6 of FIG. 5 and illustrating a connecting member 40 in engagement with a receptacle 66. As shown, the connecting member 40 and receptacle 66 are connected to their respective structures by bolts, although any sort of fastener or other means of securement may be used, and in some embodiments, connecting members 40 and receptacles 66 may be molded into or integrally formed with their respective structures. As can be appreciated from FIG. 6 and from the description above, the connecting members 40 and corresponding receptacles 66 effect a fastenerless, releasable connection with one another, allowing such a connection between the boat 10 and the console 34.

Although the engagement between the receptacles 66 and the connecting members 40 and the cut-out portion 74 of the lip 72 and bracket 70 generally provide enough structural support to hold the console 34 in place when it is installed, it is advantageous in most embodiments of the invention to provide some sort of additional locking mechanism, so as to provide additional securement and, optionally, to prevent the console 34 from being removed without a key.

Figure 7:
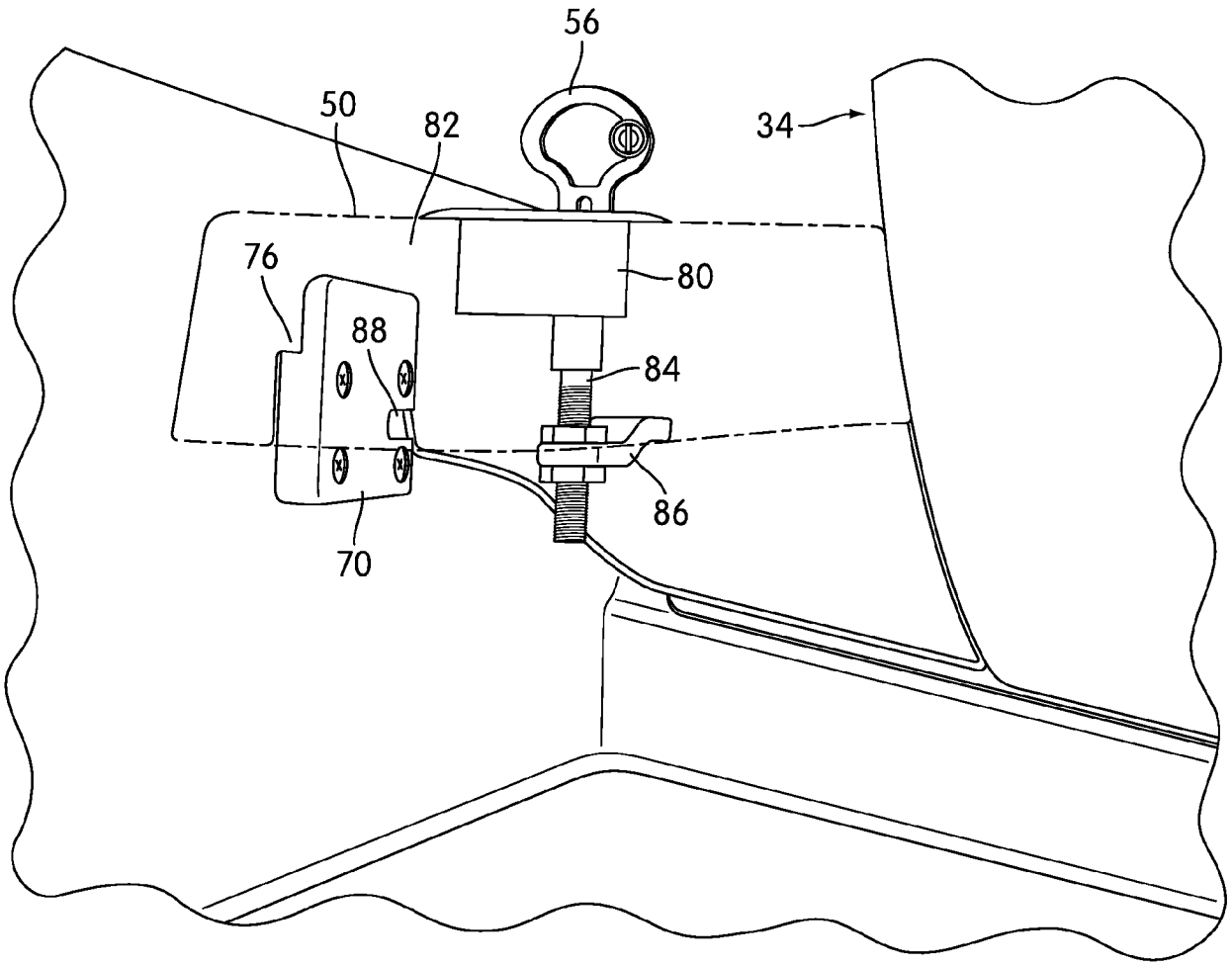
FIG. 7 is a perspective view of a portion of the removable console of FIGS. 2-3 as installed, illustrating a locking mechanism for the console in a disengaged configuration.
Figure 8:
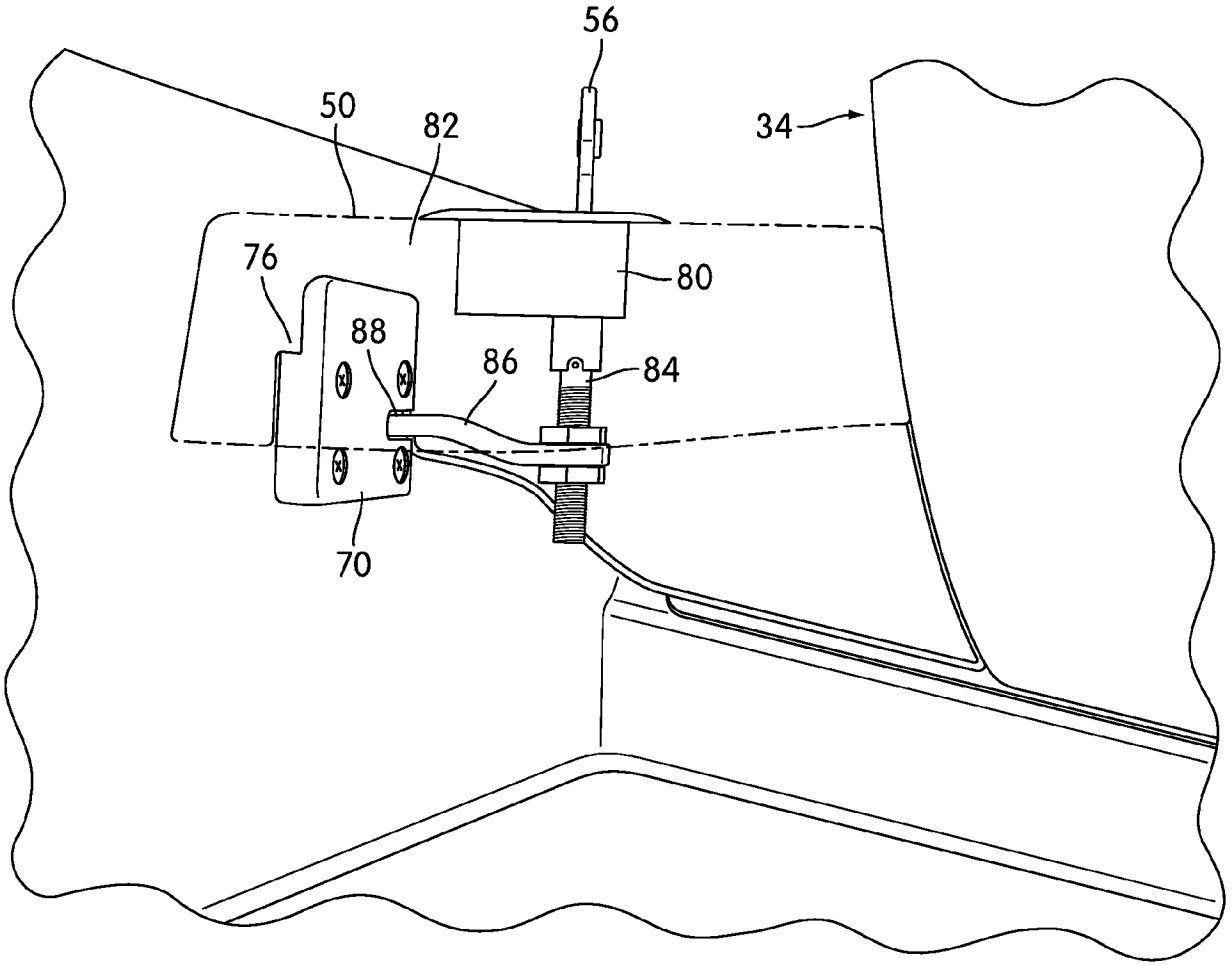
FIG. 8 is a perspective view of the boat similar to the view of FIG. 6, illustrating the locking mechanism for the console in an engaged and locked configuration.

As was described briefly above, in the illustrated embodiment, the horizontal portion 50 of the console 34 carries a locking system 54. The locking system 54 is best seen in FIG. 2 and in FIGS. 7 and 8, which are perspective views of the horizontal portion 50 as installed in the boat 10, illustrating the locking system 54 in disengaged and engaged positions, respectively. In the views of FIGS. 7 and 8, the front, downwardly-extending edge of the horizontal portion 50 is shown partially in phantom lines so as to illustrate the structure and operation of the locking system 54, which is normally partially hidden from view behind it. As shown in the figures, the rotating handle 56 is hingedly mounted so that it can be folded downward to rest generally flush with the surface of the horizontal portion 50 when not in use. Specifically, the handle 56 is carried within a receptacle 80 that is mounted within an appropriately sized opening 82 in the surface of the horizontal portion 50. The receptacle 80 extends below the surface of the horizontal portion 50 and includes a conventional locking mechanism (not shown in the figures), which is coupled to the handle 56 and also to a rod 84 that extends downwardly from the receptacle 80. The rod 84 is mounted for rotation about a generally vertical axis of rotation within the receptacle 80, such that when the locking mechanism is actuated, the rod 84 rotates.

In the illustrated embodiment, the end of the rod 84 is threaded, and secured to it by means of its threads is a generally horizontally extending tongue 86. In the position shown in FIG. 7, the locking system 54 is disengaged. To engage the locking system 54, one turns the handle 56 to rotate the rod 82 until the tongue 86 rests in the groove 88 provided in the side face of the receiving bracket 70, as shown in the view of FIG. 8. The groove 88 acts as a receptacle for the tongue 86, engaging it to secure the console 34. Once the locking system 54 is engaged, the handle 56 can be folded down so that it once again rests within the receptacle 80, generally flush with the surface of the horizontal portion 50.

Therefore, as those of skill in the art will understand, the receiving bracket 70 provides two functions, both supporting the console 34 and providing a groove 88 that receives and engages the locking system 54 of the console 34 to secure the console 34 in place. However, in other embodiments, those two functions may be provided by separate structures and, furthermore, those separate structures need not be co-located; instead, they may be located anywhere.

While the invention has been described with respect to certain embodiments, the embodiments are intended to be exemplary, rather than limiting. Modifications and changes may be made within the scope of the invention, which is defined by the claims.

What is claimed is:

1. A removable console for a boat, comprising:

a rear portion including at least two connecting structures extending therefrom, at least a portion of the at least two connecting structures being constructed and arranged to be inserted into corresponding receptacles in a boat;

an upper portion connected to the rear portion and extending upwardly and outwardly therefrom; and a side portion connected to one or both of the rear portion or the upper portion and extending generally horizontally therefrom on at least one side of the removable console, the side portion carrying user-operable engaging structure constructed and arranged to releasably secure the removable console to the boat, the side portion and the user-operable engaging structure being arranged such that the user-operable engaging structure connects to the boat at a location spaced from the receptacles;

wherein the removable console, including the rear portion, the upper portion, and the horizontal side portion can be placed in and removed from the boat at least in part by engaging and disengaging the connecting structures and the receptacles.

2. The removable console of claim 1, wherein the upper portion carries a windscreen.

3. The removable console of claim 1, further comprising a front portion that extends downwardly from the upper portion.

4. The removable console of claim 3, further comprising a lower portion connected to the upper portion and the front portion that at least partially encloses the removable console.

5. The removable console of claim 4, wherein the lower portion fully encloses the removable console.

6. The removable console of claim 1, wherein the user-operable engaging structure comprises an operable, engaging portion of a lock.

7. A boat, comprising:

a hull;

a deck arranged within the hull;

a connecting plate provided in a portion of the deck, the connecting plate having at least two receptacles spaced from one another;

a removable console including a rear portion including at least two connecting structures extending therefrom, at least a portion of the at least two connecting structures being constructed and arranged to be inserted into the at least two receptacles in the connecting plate, an upper portion connected to the rear portion and extending upwardly and outwardly therefrom, and a side portion connected to one or both of the rear portion or the upper portion and extending generally horizontally therefrom on at least one side of the removable console, the side portion carrying user-operable engaging structure constructed and arranged to releasably secure the removable console to the boat, the side portion and the user-operable engaging structure being arranged such that the user-operable engaging structure connects to the boat at a location spaced from the receptacles; and receiving structure connected to the deck, the receiving structure being constructed and arranged to receive and releasably secure the user-operable engaging structure of the removable console;

wherein the at least two connecting structures and the user-operable engaging structure provide a fastenerless, releasable connection between the removable console and the boat.

8. The boat of claim 7, wherein the upper portion carries a windscreen.

9. The boat of claim 7, wherein the removable console further comprises a front portion that extends downwardly from the upper portion.

10. The boat of claim 7, wherein the user-operable engaging structure comprises an operable, engaging portion of a lock.

11. The boat of claim 7, wherein the receiving structure comprises a receiving bracket mounted to an interior sidewall of the deck.

12. The boat of claim 7, wherein the removable console is constructed and arranged to shield a passenger seating position from wind when engaged with the boat.

* * * * *